United States Patent [19]

Brookes et al.

[11] Patent Number: 4,769,133

[45] Date of Patent: Sep. 6, 1988

[54] CENTRIFUGE ASSEMBLY FOR REMOVING SOLIDS FROM RADIOACTIVE LIQUIDS

[75] Inventors: Frederick A. Brookes, St Bees; Geoffrey W. Norris, Shevington, Nr. Wigan, both of England

[73] Assignee: British Nuclear Fuels plc, Risley, England

[21] Appl. No.: 882,720

[22] Filed: Jul. 7, 1986

[30] Foreign Application Priority Data

Jul. 15, 1985 [GB] United Kingdom ..... 8517762

[51] Int. Cl.[4] ..... B04B 7/06; B04B 11/00; B04B 15/06

[52] U.S. Cl. ..... 210/86; 210/232; 210/237; 376/310; 494/10; 494/12; 494/64

[58] Field of Search ..... 210/86, 377, 403, 232, 210/237, 366; 494/8, 60, 64, 67, 10, 12, 38, 42, 62, 27, 29; 376/310, 313

[56] References Cited

U.S. PATENT DOCUMENTS

| | | | |
|---|---|---|---|
| 53,448 | 3/1866 | Hunt | 210/377 |
| 636,383 | 11/1899 | Hartmann | 494/67 |
| 2,353,983 | 7/1944 | Banning | 494/67 X |
| 2,756,925 | 7/1956 | Selkirk | 494/12 |
| 3,627,130 | 12/1971 | Talley et al. | 210/377 X |
| 4,229,298 | 10/1980 | Bange | 210/86 X |
| 4,476,776 | 10/1984 | Greutert et al. | 210/377 X |
| 4,522,620 | 6/1985 | Leister | 210/144 |
| 4,585,558 | 4/1986 | Rubin | 210/360.1 |

FOREIGN PATENT DOCUMENTS

| | | | |
|---|---|---|---|
| 352828 | of 1931 | United Kingdom | 210/237 |

*Primary Examiner*—Richard V. Fisher
*Assistant Examiner*—Linda S. Evans
*Attorney, Agent, or Firm*—William R. Hinds

[57] ABSTRACT

A centrifuge for the removal of solids from liquids, for example, the removal of solid fission products from dissolved nuclear fuel. The centrifuge is mounted behind a solid wall and is provided with a pivotable catch tray which cooperates with a feed inlet extending through the wall of a casing about the bowl of the centrifuge. The catch tray is pivotable between a first position at which it cooperates with the feed inlet to introduce feed liquid into the bowl and a second position at which it is removed out of cooperation with the feed inlet to permit withdrawal of the bowl from the casing through a removable plug in the wall.

8 Claims, 1 Drawing Sheet

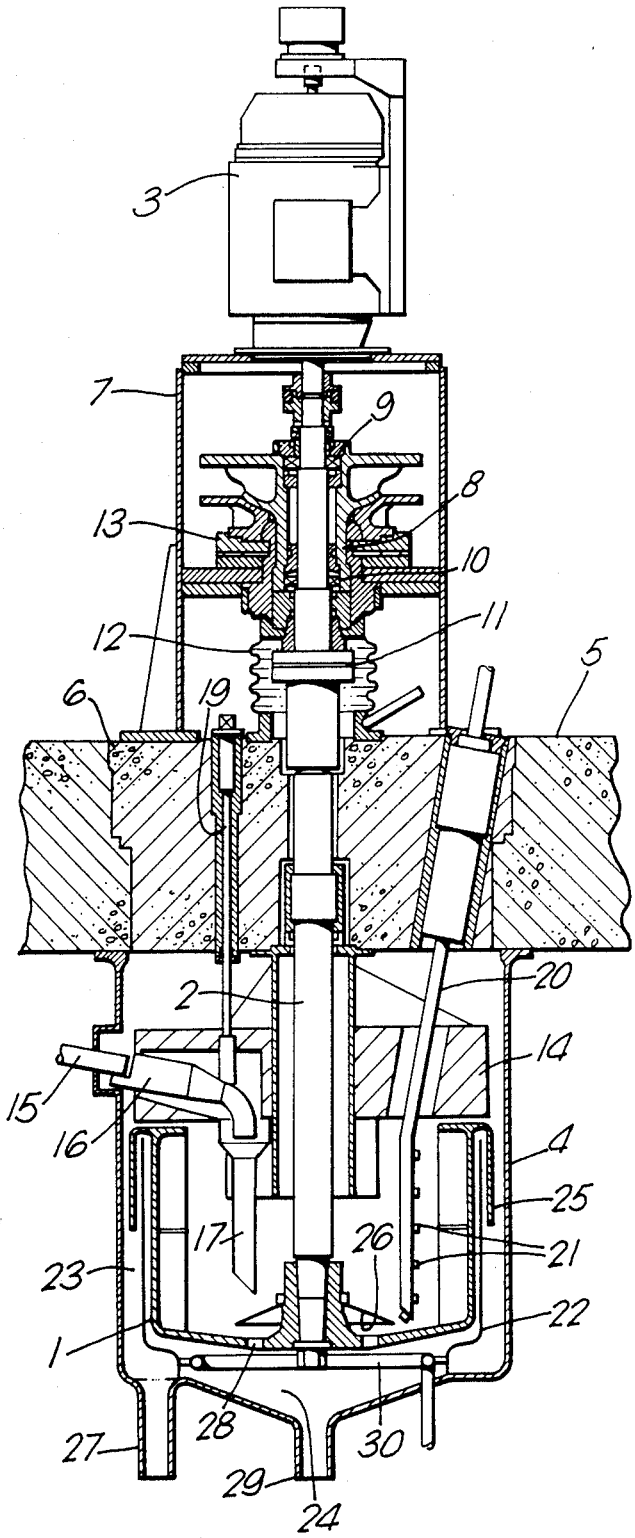
3
7
9
8
13
10
12
11
5
6
19
20
2
14
15
16
4
25
17
26
21
23
22
1
28
30
27
29
24

CENTRIFUGE ASSEMBLY FOR REMOVING SOLIDS FROM RADIOACTIVE LIQUIDS

The present invention relates to centrifuges for removing solids from fluids. In particular the invention concerns centrifuges for use in the nuclear industry for the removal of solids, such as insoluble fission products, from dissolved nuclear fuels.

FEATURES AND ASPECTS OF THE INVENTION

According to the present invention a centrifuge comprises a rotatable bowl suspended within a fixed casing, the bowl being carried on a shaft which is supported for rotation adjacent its end remote from the bowl by a bearing assembly and in which a feed inlet in the casing cooperates with a catch tray arranged above the bowl within the casing, the catch tray being pivotable between a first position at which it cooperates with the feed inlet and a second position at which it permits withdrawal of the bowl from the casing.

DESCRIPTION OF THE DRAWING

The invention will be described further, by way of example, with reference to the accompanying drawing which is a section through a centrifuge assembly for removing solids from a liquid.

DESCRIPTION OF THE PREFERRED EMBODIMENT

A centrifuge assembly, as illustrated, comprises a bowl 1 secured to an end of a shaft 2 which is driven by a motor 3. The bowl 1 is contained within a casing 4 which is secured to a mounting slab 5 with the shaft 2 passing through a plug 6 located in the slab 5. The plug sits in an opening through the slab with the plug and slab having complementary stepped surfaces. Further, the plug can only be located in the slab in one position as determined by cooperating key and keyway provided on the slab and the plug. In a preferred arrangement the plug is formed with two diametrically opposite keyways of different width which cooperate with corresponding keys in the slab. The slab and plug constitute a shield or barrier.

The motor 3 is carried on a support 7 mounted on the plug 6, the support 7 also carrying a bearing unit 8 for the rotor. The bearing unit 8 comprises upper and lower angular contact bearing assemblies 9 and 10 respectively which form a pendulum support for the shaft 2 and the centrifuge bowl 1. The shaft is formed in two parts which are coupled together at their abutting flanged ends 11. A bellows or flexible curtain 12 is disposed about the coupling 11 and extends between the bearing unit 8 and the plug 6. The bellows 12 provides a seal about the bore in the plug 6 for the shaft 2 and is removable to provide access to the coupling 11. A load cell arrangement 13 is provided making it possible to weigh the bowl and its contents during operation of the centrifuge.

A feedtray 14 is supported by the plug 6 and disposed within the casing 4 above the centrifuge bowl 1. An inlet feed pipe 15 extends through the wall of the casing to cooperate with a catch tray 16 whereby a feed liquid from the pipe 15 is directed by the catch tray 16 into an outlet 17 from the feedtray 14. The outlet 17 extends into the bowl 1 of the centrifuge. The catch tray 16 is pivotable through an arc of approximately 50° between a first position at which its outer end lies below the inlet feed pipe 15 and as shown in the drawing and a second position at which its outer end lies within the perimeter of the feedtray 14. The catch tray 16 is pivoted into the second position when it is required to lift the centrifuge assembly out of the casing 4. The feed tray 14 and the bowl 1 are dimensioned to pass through the opening in the slab 5 for the plug 6 to enable installation or withdrawal of the centrifuge with the catch tray 16 in its second position. The catch tray 16 is pivotable about the axis of a spindle 19 rotatably journalled in the plug 6, the head of the spindle 19 being accessible at the end of the plug 6 remote from the casing 4.

A washpipe 20 extends through the plug 6 and into the bowl 1. The arrangement is such that the opening in the plug 6 to receive the washpipe 20 lies outside the support 7 mounted on the plug. It is thus possible to gain immediate access to the washpipe 20. The end of the washpipe 20 within the bowl 1 can be provided with jets or nozzles 21.

The bowl 1 is located within a cylindrical wall 22 which divides the lower portion of the casing 4 into an outer annular region 23 and a central region 24. A skirt 25 which extends over the wall 22 and into the annular region 23 is welded to the bowl 1.

In use, with the bowl 1 rotating at speed, a liquid feed is introduced through the inlet 15 and the catch tray 16. The liquid falls on to a deflector plate 26 at the bottom of the bowl 1 and is thrown against the wall of the bowl. Any solids in the liquid feed collect on the wall. Clean liquid flows up the wall and over the skirt 25 into the annular region 23 from which it is removed through an outlet 27. Solids collect as a cake on the wall of the bowl. The cake can be removed periodically by reversing the direction of the bowl alternatively clockwise and anticlockwise at a slow speed, for example 10 revolutions per minute, while supplying an acid wash at pressure through the washpipe 20. The acid issuing from the jets or nozzles 21 cuts the cake from the wall. The cake and acid flow out through apertures 28 in the bottom of the bowl 1 to drain through an outlet 29 in the bottom of the casing 4, the bottom being inclined preferably at an angle of about 20°. A spray ring 30 can be provided beneath the bowl 1 to wash out deposits.

As an alternative to weighing using the load cell 13 it is possible to determine the quantity of solids deposited in the bowl by operating the centrifuge at a given speed and then switching off the power to the drive motor and noting the time required for deceleration to a lower speed. The measurements are obtained for an empty bowl and with the bowl containing solids. The difference in readings is related to the quantity of solids in the bowl.

We claim:

1. A centrifuge assembly for removing solids from radioactive liquids comprising a support plug removably located in means defining an opening in a shielding wall, a casing fixed to one side of the wall about the opening, a drive shaft extending through the plug into the casing, means for rotatably driving said drive shaft, a rotatable bowl suspended within the casing at one end of the drive shaft, the bowl being of lateral dimensions such as to be withdrawable axially through the opening, a bearing assembly about the opposite end of the drive shaft having a support mounted on the plug, a feed inlet pipe in a side wall of the casing at a position above the bowl but laterally clear of the bowl, a catch tray cooperable with the inlet pipe and arranged above the bowl in the casing, the catch tray being pivotable between a first position to lie beneath the end of the feed inlet pipe to introduce feed into the bowl and a second position laterally away from the end of the feed inlet pipe at which it permits withdrawal of the bowl from the casing through the opening in the shielding wall, and means accessible at the side of the plug remote from the casing for effecting pivotal movement of the catch tray between said positions, the arrangement of the centrifuge assembly being such that with said catch tray pivoted to said second position the bowl and any connected elements can be removed as a unit.

2. A centrifuge according to claim 1 in which the shaft is formed in two parts, and further including a releasable coupling interconnecting the two parts and disposed on the side of the plug remote from the casing.

3. A centrifuge according to claim 2 including a removable seal enclosing the coupling.

4. A centrifuge according to claim 1 including a washpipe extending through the plug into the bowl.

5. A centrifuge according to claim 1 including a cylindrical wall about the bowl in the casing and dividing the casing into inner and outer compartments.

6. A centrifuge according to claim 5 including spray wash means within the inner compartment and disposed beneath the bowl.

7. A centrifuge according to claim 1 including means for determining the quantity of solids removed from the liquid and deposited in the bowl.

8. A centrifuge according to claim 7 in which said means for determining the quantity of solids comprises a load cell.

* * * * *